US011554931B2

(12) United States Patent
Hsu

(10) Patent No.: US 11,554,931 B2
(45) Date of Patent: Jan. 17, 2023

(54) INFERRED ELEVATOR CAR ASSIGNMENTS BASED ON PROXIMITY OF POTENTIAL PASSENGERS

(71) Applicant: OTIS ELEVATOR COMPANY, Farmington, CT (US)

(72) Inventor: Arthur Hsu, South Glastonbury, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 888 days.

(21) Appl. No.: 16/426,265

(22) Filed: May 30, 2019

(65) Prior Publication Data

US 2020/0062538 A1 Feb. 27, 2020

Related U.S. Application Data

(60) Provisional application No. 62/720,518, filed on Aug. 21, 2018.

(51) Int. Cl.

| | |
|---|---|
| ***B66B 1/46*** | (2006.01) |
| ***B66B 1/24*** | (2006.01) |
| *B66B 1/34* | (2006.01) |

(52) U.S. Cl.

CPC ..... *B66B 1/2408* (2013.01); *B66B 1/468* (2013.01); *B66B 1/3407* (2013.01); *B66B 1/3461* (2013.01); *B66B 2201/223* (2013.01)

(58) Field of Classification Search

CPC ..... B66B 1/468; B66B 2201/4653; B66B 1/3461; B66B 1/3492; B66B 2201/4615;

(Continued)

(56) References Cited

U.S. PATENT DOCUMENTS 6,209,685 B1 4/2001 Zaharia et al.
9,650,225 B2 5/2017 Salmikuukka et al.

(Continued)

FOREIGN PATENT DOCUMENTS

CN 106915672 A 7/2017
CN 110626894 A * 12/2019 ..... B66B 1/468

(Continued)

OTHER PUBLICATIONS

Extended European Search Report for Application No. EP 19 19 2819 dated Jan, 27, 2020.

(Continued)

*Primary Examiner* — Marlon T Fletcher
(74) *Attorney, Agent, or Firm* — Carlson, Gaskey & Olds, P.C.

(57) ABSTRACT

An illustrative example embodiment of an elevator system includes a destination entry device configured to allow a passenger to indicate an intended destination prior to entering an elevator car and at least one detector configured to detect a proximity between the passenger and at least one other individual that has not indicated an intended destination. A controller is configured to determine whether the detected proximity between the passenger and the at least one other individual satisfies at least one criterion indicating that the at least one other individual likely is associated with the passenger, will board an elevator car with the passenger, and will travel to the intended destination with the passenger. The controller is configured to assign an elevator car to carry the passenger and the at least one other individual to the intended destination when the detected proximity satisfies the at least one criterion.

19 Claims, 2 Drawing Sheets

(58) Field of Classification Search
CPC ..... B66B 5/0012; B66B 2201/4638; B66B 1/2408; B66B 3/006; B66B 2201/463; B66B 1/3446; B66B 1/3415; B66B 2201/103; B66B 3/02; B66B 5/0006; B66B 2201/222; B66B 1/52; B66B 2201/223; B66B 2201/4607; B66B 1/46
See application file for complete search history.

(56) References Cited

U.S. PATENT DOCUMENTS

| | | | |
|---|---|---|---|
| 9,725,279 | B2 | 8/2017 | Armistead |
| 9,764,923 | B2 | 9/2017 | Finschi |
| 9,878,874 | B2 | 1/2018 | Kondo et al. |
| 9,957,132 | B2 | 5/2018 | Berryhill |
| 9,988,238 | B2 | 6/2018 | Simcik et al. |
| 2015/0291388 | A1 | 10/2015 | Hovi et al. |
| 2016/0090271 | A1 | 3/2016 | Silvennoinen et al. |
| 2016/0251198 | A1 | 9/2016 | Salmikuukka et al. |
| 2017/0260024 | A1 | 9/2017 | Sha et al. |
| 2017/0291792 | A1* | 10/2017 | Scoville ..... B66B 1/3407 |
| 2018/0099840 | A1 | 4/2018 | Armistead |
| 2019/0389689 | A1* | 12/2019 | Jia ..... B66B 1/28 |
| 2020/0062538 | A1* | 2/2020 | Hsu ..... B66B 1/2408 |
| 2020/0130987 | A1* | 4/2020 | Scoville ..... B66B 1/468 |
| 2020/0331723 | A1* | 10/2020 | Sudi ..... B66B 1/2408 |

FOREIGN PATENT DOCUMENTS

| | | | | |
|---|---|---|---|---|
| EP | 3587321 | A1 * | 1/2020 | ..... B66B 1/2458 |
| EP | 3587321 | A1 | 1/2020 | |
| EP | 3613689 | A1 * | 2/2020 | ..... B66B 1/06 |
| EP | 3889090 | A1 * | 10/2021 | |
| EP | 4008658 | A1 * | 6/2022 | ..... B66B 1/18 |
| JP | 2017114670 | A | 6/2017 | |
| WO | WO-2020157367 | A1 * | 8/2020 | |

OTHER PUBLICATIONS

Lutfi Al-Sharif, Introduction to Elevator Group Control (Mete Xi), Lift Report 2016; 42(2): 59-68.

* cited by examiner

INFERRED ELEVATOR CAR ASSIGNMENTS BASED ON PROXIMITY OF POTENTIAL PASSENGERS

CROSS REFERENCE TO RELATED APPLICATION

This application claims priority to U.S. Provisional Application No. 62/720,518, filed on Aug. 21, 2018.

BACKGROUND

Elevator systems have proven useful for carrying passengers between different levels in a building. For many years an individual desiring elevator service would indicate an intended direction of travel from a particular floor by pressing a hall call button. In response to such a call the elevator system controller would determine whether the passenger intended to travel up or down from the boarding floor and direct a car to that floor, illuminate a direction light near the entrance to the car, and open the door so the passenger could board. Once in the elevator car the passenger is able to indicate an intended destination floor through a car operating panel, which typically includes a set of buttons corresponding to the potential destination floors.

Advances in technology have allowed for elevator systems to become more sophisticated or versatile. For example, destination entry systems allow passengers to enter an intended destination prior to entering an elevator car. An elevator dispatch controller determines which elevator car will most efficiently service each such request and assigns an elevator car for each passenger. The car assignment process usually includes considering whether sufficient room is available in a candidate car based on the number of passengers assigned to that car. Once a suitable car is identified, there are various known techniques to notify the passenger which car has been assigned to travel to the intended destination.

One challenge associated with destination entry systems is that not every individual desiring service will place a call. Instead, for example, if several people intend to travel together in an elevator car oftentimes only one of them will place the call. The dispatch controller typically does not have the ability to determine whether additional passengers will accompany the individual who placed the call. There may not be adequate room on an elevator car that is assigned to several passengers when, in reality, several more intend to board that car. This scenario is particularly challenging in peak traffic situations when many people desire elevator service at or around the same time and passengers may be frustrated that the assigned car fills up before they are able to board.

SUMMARY

An illustrative example embodiment of an elevator system includes a destination entry device configured to allow a passenger to indicate an intended destination prior to entering an elevator car and at least one detector configured to detect a proximity between the passenger and at least one other individual that has not indicated an intended destination. A controller is configured to determine whether the detected proximity between the passenger and the at least one other individual satisfies at least one criterion indicating that the at least one other individual likely is associated with the passenger, will board an elevator car with the passenger, and will travel to the intended destination with the passenger. The controller is configured to assign an elevator car to carry the passenger and the at least one other individual to the intended destination when the detected proximity satisfies the at least one criterion.

In an example embodiment having one or more features of the elevator system of the previous paragraph, the detected proximity includes an indication of a distance between the passenger and the at least one other individual, the at least one criterion comprises a distance threshold, and the at least one criterion is satisfied when the indication of the distance is below the distance threshold.

In an example embodiment having one or more features of the elevator system of any of the previous paragraphs, the detected proximity satisfies the at least one criterion, the detector is configured to detect a second proximity between at least one second individual and either of the passenger or the at least one other individual, the at least one second individual has not indicated an intended destination through the destination entry device, the controller is configured to determine whether the second proximity satisfies the at least one criterion indicating that the at least one second individual is likely associated with the passenger and will board the elevator car with the passenger and travel to the intended destination with the passenger, and the controller is configured to assign the elevator car to carry the at least one second individual with the passenger and the at least one other individual to the intended destination.

In an example embodiment having one or more features of the elevator system of any of the previous paragraphs, the controller is configured to determine a duration of the detected proximity, the at least one criterion comprises a time threshold, and the at least one criterion is satisfied when the duration exceeds the time threshold.

In an example embodiment having one or more features of the elevator system of any of the previous paragraphs, the detector is configured to provide an indication of a first zone in which the passenger is located, the detector is configured to provide an indication of a second zone in which the at least one other individual is located, and the controller is configured to determine whether a relationship between the first zone and the second zone satisfies the at least one criterion.

In an example embodiment having one or more features of the elevator system of any of the previous paragraphs, the at least one criterion includes the first zone and the second zone being the same or the first zone being within a threshold distance of the second zone.

In an example embodiment having one or more features of the elevator system of any of the previous paragraphs, the detector is configured to provide an indication of respective positions of the passenger and the at least one other individual relative to at least one reference location and the detected proximity is based on a distance between the respective positions.

In an example embodiment having one or more features of the elevator system of any of the previous paragraphs, the detected proximity includes an indication of respective movement of the passenger and the at least one other individual and the at least one criterion is satisfied when the respective movements correspond to the passenger and the at least one other individual moving together toward or near a landing of the elevator system.

In an example embodiment having one or more features of the elevator system of any of the previous paragraphs, the detector comprises a turnstile through which individuals must pass before approaching an elevator car of the elevator system, the detected proximity includes an indication of respective turnstiles through which the passenger and the at least one other individual passed, the detected proximity includes an indication of respective times when the passenger and the at least one other individual passed through the respective turnstiles, and the at least one criterion is satisfied when the respective turnstiles are within a threshold distance of each other and the respective times are within a threshold time of each other.

In an example embodiment having one or more features of the elevator system of any of the previous paragraphs, the controller is configured to determine whether the passenger and the at least one other individual have previously used the elevator system to travel together to the intended destination, and determine whether the at least one criterion is satisfied based on whether the passenger and the at least one other individual have previously used the elevator system to travel together to the intended destination.

An illustrative example method of managing elevator car assignments in response to service requests that indicate an intended destination of a passenger outside of an elevator car includes receiving a service request from a passenger outside of an elevator car, the service request indicating an intended destination of the passenger; detecting a proximity between the passenger and at least one other individual that has not indicated an intended destination; determining whether the detected proximity between the passenger and the at least one other individual satisfies at least one criterion indicating that the at least one other individual is likely associated with the passenger and will board an elevator car with the passenger and travel to the intended destination with the passenger; and assigning an elevator car to carry the passenger and the at least one other individual to the intended destination when the at least one criterion is satisfied.

In an example embodiment having one or more features of the method of the previous paragraph, detecting the proximity includes providing an indication of a distance between the passenger and the at least one other individual; the at least one criterion comprises a distance threshold; and determining whether the detected proximity between the passenger and the at least one other individual satisfies at least one criterion includes determining whether the indication of the distance is below the distance threshold.

In an example embodiment having one or more features of the method of any of the previous paragraphs, the detected proximity satisfies the at least one criterion; the at least one second individual has not indicated an intended destination; and the method includes detecting a second proximity between at least one second individual and either of the passenger or the at least one other individual, determining whether the second proximity satisfies the at least one criteria indicating that the at least one second individual is likely associated with the passenger and will board the elevator car with the passenger and travel to the intended destination with the passenger, and assigning the elevator car to carry the at least one second individual with the passenger and the at least one other individual to the intended destination.

In an example embodiment having one or more features of the method of any of the previous paragraphs, the at least one criterion comprises a time threshold; and the method includes determining a duration of the detected proximity, and determining that the at least one criterion is satisfied when the duration exceeds the time threshold.

An example embodiment having one or more features of the method of any of the previous paragraphs includes determining a first zone in which the passenger is located; determining a second zone in which the at least one other individual is located; and determining whether a relationship between the first zone and the second zone satisfies the at least one criterion.

In an example embodiment having one or more features of the method of any of the previous paragraphs, the at least one criterion includes the first zone and the second zone being the same or the first zone being within a threshold distance of the second zone.

An example embodiment having one or more features of the method of any of the previous paragraphs includes determining respective positions of the passenger and the at least one other individual relative to at least one reference location, and wherein the detected proximity is based on a distance between the respective positions.

An example embodiment having one or more features of the method of any of the previous paragraphs includes detecting respective movement of the passenger and the at least one other individual, and wherein the at least one criterion is satisfied when the respective movements correspond to the passenger and the at least one other individual moving together toward or near a landing of the elevator system.

In an example embodiment having one or more features of the method of any of the previous paragraphs, detecting the proximity comprises determining respective turnstiles through which the passenger and the at least one other individual passed; determining respective times when the passenger and the at least one other individual passed through the respective turnstiles; and determining that the at least one criterion is satisfied when the respective turnstiles are within a threshold distance of each other and the respective times are within a threshold time of each other.

An example embodiment having one or more features of the method of any of the previous paragraphs includes determining whether the passenger and the at least one other individual have previously used the elevator system to travel together to the intended destination, and determining whether the at least one criterion is satisfied based on whether the passenger and the at least one other individual have previously used the elevator system to travel together to the intended destination.

The various features and advantages of at least one disclosed example embodiment will become apparent to those skilled in the art from the following detailed description. The drawings that accompany the detailed description can be briefly described as follows.

DETAILED DESCRIPTION

Embodiments of this invention provide the ability to determine how many passengers are likely to board an elevator car to travel to a particular destination even when less than all of the potential passengers have provided an indication of an intended destination prior to entering an elevator car. Inferences based on determining whether individuals approaching an elevator landing are in close proximity to each other allow for associating such individuals with a scheduled passenger and reserving space for such individuals on the same car as that passenger.

Figure 1:
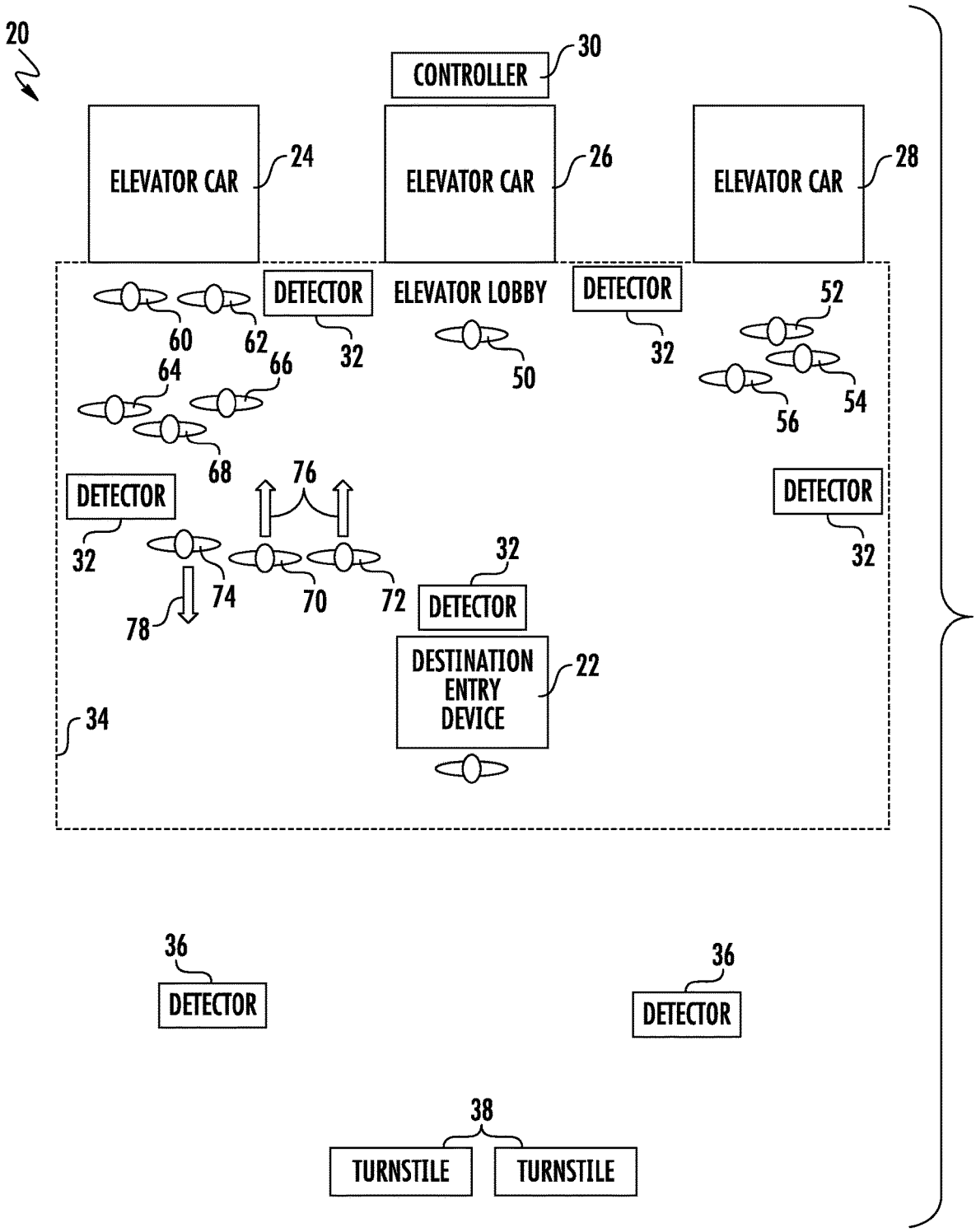
FIG. 1 schematically illustrates selected portions of an elevator system designed according to an embodiment of this invention and an example scenario in which the example elevator system determines how many passengers intend to travel to at least one destination.

FIG. 1 schematically illustrates selected portions of an elevator system 20. A destination entry device 22 allows passengers desiring elevator service to enter a service request including an intended destination prior to entering any of the elevator cars 24, 26 and 28. In the illustrated embodiment, the elevator cars 24, 26 and 28 do not include a car operating panel and passengers are not able to indicate a desired destination from within any of the cars. A controller 30, which includes at least one computing device, determines which of the elevator cars 24, 26 and 28 to assign to each passenger using a known dispatching or elevator car assignment algorithm.

The controller 30 is configured or programmed to assign an elevator car to other individuals who have not entered a service request through the destination entry device 22. At least one detector 32 provides an indication of a proximity between a passenger who entered a service request and at least one other individual. The controller 30 uses information regarding such a proximity to determine whether the other individual is likely associated with the passenger and will board the elevator car and travel to the intended destination with the passenger.

The detectors 32 in the illustrated embodiment are known devices. Example detectors include cameras that provide video or image data or depth sensors. Other detectors do not use image-based detection. Some embodiments include indoor GPS detectors that provide indications of the positions of different individuals. Other embodiments include signaling techniques such as triangulation or signal strength determinations to locate individuals. Some detectors are able to recognize a mobile station or an RFID device carried by an individual and use such devices to locate and track individuals.

In some embodiments determining proximity includes determining an approximate distance between different individuals. The distance may be based on individual locations or distances from a detector. In some embodiments the distance determination is zone-based in that the detectors 32 provide an indication of a zone within which an individual is located. For example, the elevator lobby 34 in FIG. 1 may be divided into multiple zones or sections. Depending on the size of the zones and the accuracy capabilities of the detectors 32, two individuals may be considered in close enough proximity to each other to be likely associated and traveling together on an elevator car if they are in the same zone or if they are respectively in zones that are close enough to each other to indicate a close proximity between them.

In another embodiment, distances between individuals are determined based on signaling or communications between mobile devices carried by those individuals. Instead of having a fixed reference point or device, the individual mobile devices detect signal strength of other mobile devices to identify nearby devices and, therefore, individuals. The relative signal strengths provide indications of the relative distances between the individuals.

In addition to the detectors 32 within the elevator lobby 34 or situated to detect individuals in the elevator lobby 34, the illustrated example includes detectors 36 outside of or spaced from the elevator lobby 34. The detectors 36 can provide information to the controller 30 regarding individuals moving toward the elevator lobby, for example, which may be useful to identify potentially associated individuals even when the elevator lobby 34 becomes crowded.

In the illustrated example, at least some of the sensors 34 and 36 provide indications of movement of individuals so the controller 30 may take coordinated movement of individuals into account when determining whether they are associated and likely to travel together on an elevator car. Taking coordinated movement into account provides a more robust and accurate determination as it is possible for unassociated individuals to be near each other at a moment in time but it is less likely that unassociated individuals will remain near each other while moving through an area such as the elevator lobby 34 or another part of a building.

The illustrated embodiment includes security turnstiles 38 through which an individual must pass to enter a building including the elevator system 20. In this embodiment, the controller 30 is configured to utilize information from the turnstiles 38 as at least a portion of a proximity determination. One aspect of some known security turnstiles is that they provide information regarding a person's identity, the specific turnstile used and the time of passage. Such information may be used by the controller 30 when determining if two individuals are in close enough proximity to be likely to ride together on an elevator car to a common destination.

When, for example, two individuals enter through turnstiles 38 that are close to each other within a time that satisfies a threshold, they can be considered in close enough proximity to each other to be associated. If the turnstiles each uses are remote from each other, which may be at different building entrances, or the time between their respective entries is too long, then they are not considered in close enough proximity to each other to be associated or likely to travel together on an elevator car.

Figure 2:
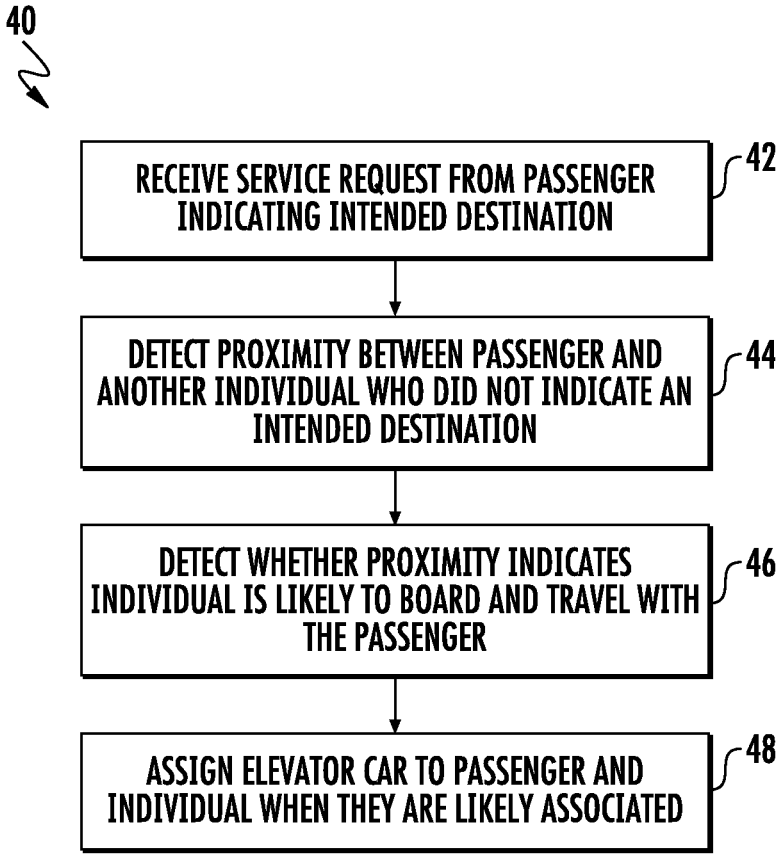
FIG. 2 is a flow chart diagram summarizing an example method of determining how many passengers intend to travel to at least one destination designed according to an embodiment of this invention.

Regardless of the type of detectors 32, 36, 38, the controller 30 determines whether individuals who have not entered a service request through the destination entry device 22 may be travelling with another passenger who did enter such a request. FIG. 2 is a flow chart diagram 40 that summarizes an example approach. At 42, a passenger enters an elevator service request through the destination entry device 22 including an indication of the passenger's intended destination. At 44, at least one of the detectors 32, 26, 38 provides an indication of the proximity between the passenger and at least one other individual who did not enter an elevator service request.

Recognizing the passenger and any other individual to distinguish who has entered a request and who has not may be accomplished in different ways. Some example embodiments include facial recognition and the ability to track individuals through an area such as the elevator lobby 34 to recognize those who entered a request and those who did not. Another embodiment utilizes information regarding a number of people in the elevator lobby 34 and the number of requests received at 42 with the difference indicating how many people did not enter their own requests. Other embodiments use device recognition techniques to recognize a mobile station or RFID device carried by individuals and an ability to associate such devices with requests that have been entered.

At 46, the controller uses information from at least one of the detectors 32, 36, 38 to determine whether a proximity between the passenger who entered a request and another individual that did not enter a request satisfies at least one criterion that indicates that the two are likely associated and will board and travel together on the same elevator car to that passenger's intended destination.

In some embodiments the determination at 46 includes determining how close the individuals are to each other or a distance between them. If that distance is less than a threshold distance the individuals under consideration are considered associated. In other embodiments the criterion used at 46 includes movement of the individuals that is monitored or tracked over time. When two individuals move together or whose movement is coordinated or similar as they progress toward the elevator lobby 34 or elevator cars 24, 26 and 28 they are considered associated. On the other hand, when two individuals are not moving together or in a coordinated manner they will not be considered associated. As mentioned above, other criteria may be used to make the determination at 46.

Once at least one other individual is determined to be associated with the passenger who entered a service request, the controller 30 assigns the same elevator car to the passenger and the other individual or individuals at 48. In this way the controller 30 is able to monitor the total number of likely or expected people on an elevator car and to reserve adequate space to accommodate them even when less than all of them have specifically requested elevator service. The approach taken by the controller 30 enhances the passenger's experience and convenience and can improve overall elevator system performance during peak travel times.

The scenario schematically represented in FIG. 1 demonstrates various ways in which the controller may assign elevator cars. A passenger 50 entered a request and the controller 30 assigned the elevator car 26 to the passenger 50. Since no one else is near the passenger 50, the controller 30 does not associate any other individuals with that request.

Another passenger 52 entered a request for service to another intended destination and the controller 30 has assigned the elevator car 28 to the passenger 52. Two other individuals 54 and 56 did not enter a request through the destination entry device 22. The individual 54 is close enough to the passenger 52 that the distance between them satisfies the proximity criteria used by the controller 30 to determine that the individual 54 is associated with the passenger 52. The controller 30 has therefore assigned the elevator car 28 to the individual or at least counted the individual 54 among those expected to board the elevator car 28 and travel to the intended destination of the passenger 52.

The individual 56 in this example is not close enough to the passenger 52 to satisfy a minimum threshold distance to be considered directly associated with the passenger 52. The individuals 54 and 56, however, are close enough to each other to satisfy the proximity criteria used by the controller 30 and the controller determines that the individuals 54 and 56 are likely associated and will travel together on the elevator car 28. The controller 30 in this example, therefore, associates the individual 56 with the passenger 52 and assigns the elevator car 28 to the individual 56.

This example scenario demonstrates one way in which the controller uses an indication of a proximity between an individual and a passenger or another individual already associated with that passenger to determine that both of those individuals are associated with the same passenger.

Other people are waiting outside the elevator car 24. In this instance a passenger 60 entered a request but another individual 62 has not. Since the passenger 60 and the individual 62 were tracked moving together from near the destination entry device through the elevator lobby 34, the controller determined them to be associated and assigned the elevator car 24 to the individual 62 along with the passenger 60. The other individuals 64, 66 and 68 did not enter elevator service requests and are all waiting outside the same elevator car 24 but none of them is close enough to the passenger 60 or the individual 62 to satisfy a distance-based proximity criterion to be considered associated with the passenger 60. Prior to being situated as shown in FIG. 1, the individuals 64 and 68 were walking alongside and conversing with the passenger 60 and the other individual 62. The controller uses that information to associate the individuals 64 and 68 with the passenger 60 and assigns them to the elevator car 24 on that basis. The individual 66 may be associated with the individuals 64 and 68 even though that individual was not detected walking with the others because the individual 66 entered through a turnstile 38 close to and at about the same time as the individual 64, for example.

Three other people 70, 72 and 74 are all close enough to each other to satisfy a distance-based proximity criterion. The passenger 70 is the only one of those three who entered an elevator service request through the destination entry device 22. The controller 30 determines that the individual 72 is likely associated with the passenger 70 and will travel on the same elevator car to the same destination based on how close they are to each other and moving in the same direction as indicated by the arrows 76. The individual 76, by contrast, is not heading in the same direction as indicated by the arrow 78. The controller 30 in this example considers the different directions of movement of the individual 74 and the passenger 70 to indicate that they are not associated or at least not likely to travel on the same elevator car to the same destination.

Other combinations of proximity criteria may be used to determine when individuals who did not enter a request for elevator service are likely associated with a passenger who did request service to an intended destination. The criteria, any weight assigned to a particular criterion, and the way in which the controller 30 processes associated information may vary depending on the type of detectors 34, 36 and 38, for example.

In addition to proximity information, some embodiments include utilizing other known characteristics of individuals to determine whether they are likely associated and will travel on the same elevator car to the same destination. For example, when individuals may be identified based on facial recognition or a device signature or identity the controller 30 stores associations between individuals who travel together to the same destination and uses such past behavior to increase a confidence factor regarding a likelihood that the individuals are associated. Additionally, the controller 30 may have access to a database that includes associations and default destinations of individuals, such as employees of a particular business and the floor where each works. Such additional information is used in some embodiments as part of the process of determining whether an individual who did not enter an intended destination should be assigned to the same elevator car of another passenger.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. An elevator system, comprising:

an elevator call entry device configured to allow a passenger to indicate at least one of an intended destination and an intended direction prior to entering an elevator car;

at least one detector configured to detect a proximity between the passenger and at least one other individual that has not indicated an intended destination through the destination entry device; and a controller configured to determine whether the detected proximity between the passenger and the at least one other individual satisfies at least one criterion indicating that the at least one other individual is likely associated with the passenger and will board an elevator car with the passenger and travel to the intended destination with the passenger, determine whether the passenger and the at least one other individual have previously used the elevator system to travel together to the intended destination based on stored information regarding at least one previous association of the passenger and the at least one other individual, determine whether the at least one criterion is satisfied based on whether the passenger and the at least one other individual have previously used the elevator system to travel together to the intended destination, and assign an elevator car to carry the passenger and the at least one other individual to the intended destination when the detected proximity satisfies the at least one criterion.

2. The elevator system of claim 1, wherein the detected proximity includes an indication of a distance between the passenger and the at least one other individual;

the at least one criterion comprises a distance threshold; and the at least one criterion is satisfied when the indication of the distance is below the distance threshold.

3. The elevator system of claim 1, wherein the detected proximity satisfies the at least one criterion;

the detector is configured to detect a second proximity between at least one second individual and either of the passenger or the at least one other individual;

the at least one second individual has not indicated an intended destination through the destination entry device;

the controller is configured to determine whether the second proximity satisfies the at least one criterion indicating that the at least one second individual is likely associated with the passenger and will board the elevator car with the passenger and travel to the intended destination with the passenger; and the controller is configured to assign the elevator car to carry the at least one second individual with the passenger and the at least one other individual to the intended destination.

4. The elevator system of claim 1, wherein the controller is configured to determine a duration of the detected proximity;

the at least one criterion comprises a time threshold; and the at least one criterion is satisfied when the duration exceeds the time threshold.

5. The elevator system of claim 1, wherein the detector is configured to provide an indication of a first zone in which the passenger is located;

the detector is configured to provide an indication of a second zone in which the at least one other individual is located; and the controller is configured to determine whether a relationship between the first zone and the second zone satisfies the at least one criterion.

6. The elevator system of claim 5, wherein the at least one criterion includes the first zone and the second zone being the same or the first zone being within a threshold distance of the second zone.

7. The elevator system of claim 1, wherein the detector is configured to provide an indication of respective positions of the passenger and the at least one other individual relative to at least one reference location; and the detected proximity is based on a distance between the respective positions.

8. The elevator system of claim 1, wherein the detected proximity includes an indication of respective movement of the passenger and the at least one other individual; and the at least one criterion is satisfied when the respective movements correspond to the passenger and the at least one other individual moving together toward or near a landing of the elevator system.

9. The elevator system of claim 1, wherein the detector comprises a turnstile through which individuals must pass before approaching an elevator car of the elevator system;

the detected proximity includes an indication of respective turnstiles through which the passenger and the at least one other individual passed;

the detected proximity includes an indication of respective times when the passenger and the at least one other individual passed through the respective turnstiles; and the at least one criterion is satisfied when the respective turnstiles are within a threshold distance of each other and the respective times are within a threshold time of each other.

10. A method of making elevator car assignments, the method comprising:

receiving a service request from a passenger outside of an elevator car, the service request indicating an intended destination of the passenger;

detecting a proximity between the passenger and at least one other individual that has not indicated an intended destination;

determining whether the detected proximity between the passenger and the at least one other individual satisfies at least one criterion indicating that the at least one other individual is likely associated with the passenger and will board an elevator car with the passenger and travel to the intended destination with the passenger;

determining whether the passenger and the at least one other individual have previously used the elevator system to travel together to the intended destination based on stored information regarding at least one previous association of the passenger and the at least one other individual;

determining whether the at least one criterion is satisfied based on whether the passenger and the at least one other individual have previously used the elevator system to travel together to the intended destination; and assigning an elevator car to carry the passenger and the at least one other individual to the intended destination when the at least one criterion is satisfied.

11. The method of claim 10, wherein detecting the proximity includes providing an indication of a distance between the passenger and the at least one other individual;

the at least one criterion comprises a distance threshold; and determining whether the detected proximity between the passenger and the at least one other individual satisfies at least one criterion includes determining whether the indication of the distance is below the distance threshold.

12. The method of claim 10, wherein the detected proximity satisfies the at least one criterion;

the at least one other individual has not indicated an intended destination; and the method comprises detecting a second proximity between at least one second individual and either of the passenger or the at least one other individual, determining whether the second proximity satisfies the at least one criteria indicating that the at least one second individual is likely associated with the passenger and will board the elevator car with the passenger and travel to the intended destination with the passenger, and assigning the elevator car to carry the at least one second individual with the passenger and the at least one other individual to the intended destination.

13. The method of claim 10, wherein the at least one criterion comprises a time threshold; and the method comprises determining a duration of the detected proximity, and determining that the at least one criterion is satisfied when the duration exceeds the time threshold.

14. The method of claim 10, comprising determining a first zone in which the passenger is located;

determining a second zone in which the at least one other individual is located; and determining whether a relationship between the first zone and the second zone satisfies the at least one criterion.

15. The method of claim 14, wherein the at least one criterion includes the first zone and the second zone being the same or the first zone being within a threshold distance of the second zone.

16. The method of claim 10, comprising determining respective positions of the passenger and the at least one other individual relative to at least one reference location, and wherein the detected proximity is based on a distance between the respective positions.

17. The method of claim 1, comprising detecting respective movement of the passenger and the at least one other individual, and wherein the at least one criterion is satisfied when the respective movements correspond to the passenger and the at least one other individual moving together toward or near a landing of the elevator system.

18. The method of claim 10, wherein detecting the proximity comprises determining respective turnstiles through which the passenger and the at least one other individual passed;

determining respective times when the passenger and the at least one other individual passed through the respective turnstiles; and determining that the at least one criterion is satisfied when the respective turnstiles are within a threshold distance of each other and the respective times are within a threshold time of each other.

19. A method of making elevator car assignments, the method comprising:

receiving a service request from a passenger outside of an elevator car, the service request indicating an intended destination of the passenger;

detecting a proximity between the passenger and at least one other individual that has not indicated an intended destination;

determining whether the detected proximity between the passenger and the at least one other individual satisfies at least one criterion indicating that the at least one other individual is likely associated with the passenger and will board an elevator car with the passenger and travel to the intended destination with the passenger, wherein the at least one criterion comprises a duration of the detected proximity, and determining that the at least one criterion is satisfied when the duration exceeds the time threshold; and assigning an elevator car to carry the passenger and the at least one other individual to the intended destination when the at least one criterion is satisfied.

* * * * *